United States Patent [19]

Emtage et al.

[11] 3,975,658

[45] Aug. 17, 1976

[54] MASS OF CURRENT INRUSH LIMITERS

[75] Inventors: Peter R. Emtage, Pittsburgh; Philip J. Nalepa, Greensburg; Robert C. Miller, Pittsburgh, all of Pa.

[73] Assignee: Westinghouse Electric Corporation, Pittsburgh, Pa.

[22] Filed: June 10, 1975

[21] Appl. No.: 585,732

[52] U.S. Cl. ..... 315/71; 315/309; 315/311

[51] Int. Cl.[2] ..... H05B 39/04

[58] Field of Search ..... 315/71, 291, 309, 311; 338/22 R, 22 SD

[56] References Cited

UNITED STATES PATENTS 3,467,937 9/1969 Norton ..... 315/71 UX

*Primary Examiner*—James B. Mullins

*Attorney, Agent, or Firm*—W. D. Palmer

[57] ABSTRACT

An arrangement to eliminate the initial current overshoot which normally occurs when a tungsten incandescent lamp is connected to a power source. The arrangement uses a negative temperature coefficient thermistor having a certain predetermined mass. It has been determined that a practical limiter to eliminate current overshoot can be made only when the mass of the limiter is within a relatively narrow range. The hot and cold resistance of the limiter must also be within prescribed ranges to give a limiter which is not only effective in eliminating the current overshoot, but also efficient in steady state operation such that the limiter dissipates less than 1% of the total power.

6 Claims, 9 Drawing Figures

MASS OF CURRENT INRUSH LIMITERS

CROSS REFERENCE TO RELATED APPLICATIONS

In copending applications Ser. No. 525,414, filed Nov. 18, 1974, which is a continuation of Ser. No. 339,491, filed Mar. 8, 1973 both now abandoned, there is disclosed the use of a polycrystalline vanadium oxide (approximately $VO_2$) as a current inrush limiter for incandescent lamps. Refinements of this concept provided the first current inrush limiter which was effective in completely eliminating current overshoots and also highly efficient.

In copending application Ser. No. 585,731 filed concurrently with this application and by the same inventors as this application and assigned to the same assignee, there is disclosed an improved composition of vanadium oxide current limiters. The improved composition is also primarily polycrystalline vanadium dioxide, but also contains $MoO_3$ in amounts between 0.003 and 0.06% by weight, which addition provides a more gradual transition and also provides a resistance which varies less at temperatures below the transition temperature.

BACKGROUND OF THE INVENTION

This invention relates to inrush current limiters for tungsten incandescent lamp filaments, and particularly to an arrangement to efficiently eliminate current overshoot.

It has long been known that the large inrush currents typical of tungsten lamp filaments are detrimental and many suggestions of various negative temperature coefficient thermistors have been made. The large inrush currents have detrimental effects both on the electricl systems supplying the power and on the lamps themselves. A number of detrimental effects on the lamp itself are known. These effects include, for example, the electromechanical effects of the large currents, but the most straightforward effect is probably the failure of the filament due to localized melting caused by local thermal overshoots. In this failure mode, a localized high resistance section is much more intensely heated due to its initial higher resistance. This is then compounded due to the localized resistance rising more rapidly than the rest of the filament (tungsten having a positive temperature coefficient, any local section having greater cold resistance will receive proportionally greater power input, heating that section more than average, causing its resistance to become even higher and thus even more intensely heated). Because the localized section has heated up much faster than the remainder of the filament, it can reach or exceed operating temperature before the total filament resistance has risen to the operation value. Thus, the local section is subjected to higher than steady state operating current even after the local section resistance has risen to or above its steady state operating value. This combination produces intense local heating and temperatures even higher than the steady state temperature of that section. If a localized section reaches the melting point of tungsten, the filament fails.

Despite the long felt need, the thermistor configurations of the prior art have either failed to eliminate the inrush current overshoot or were excessively inefficient. Often the devices were both inefficient and ineffective. Several of the prior art devices, especially those with a very large thermistor mass or with a switching characteristic, delayed the current overshoot but did not eliminate it. While some of the configurations did extend the life of a lamp, this was primarily due to an excessive residual resistance in series with the filament which lowers the voltage across the filament which results in a very inefficient lamp with dramatically lower light output.

SUMMARY OF THE INVENTION

It has been determined that localized thermal overshoots are eliminated by eliminating the current overshoot and that efficient and effective elimination of the current overshoot is obtained when the initial and steady state resistance of the limiter are in the correct ranges but only if the effective mass of the thermistor is also appropriate.

This circuit arrangement effectively eliminates the inrush current overshoot that would otherwise occur when the incandescent lamp is connected to a power source. The arrangement has a current inrush limiter (comprising a negative temperature coefficient thermistor) electrically connected in series with an incandescible tungsten lamp filament. The inrush current limiter has a room temperature resistance of between about 0.9 and ten times the hot resistance of the filament and a steady state operating resistance of less than about 1% of the hot resistance of the filament. The thermistor has an effective mass equal to between 400 and 4,000 multiplied by the mass of the filament, multiplied by the initial current through the thermistor, divided by the difference in calories/gram between the hot heat (at the temperature when thermistor resistance has fallen to 15% of its room temperature resistance) content per unit mass of the thermistor and the cold heat content per unit mass of the thermistor, and also divided by the initial current through the filament.

BRIEF DESCRIPTION OF THE DRAWINGS

The invention can be best understood by reference to the following drawings in which.

DESCRIPTION OF THE PREFERRED EMBODIMENTS

Figure 1:
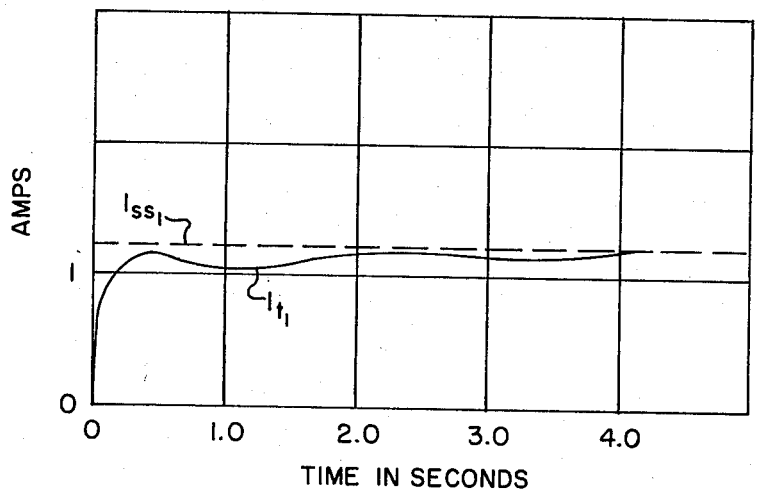
FIG. 1 is a graph showing the variation of current with time of a tungsten incandescent lamp filament in series with a current inrush limiting thermistor.

Efficient and effective current inrush limiting can be obtained only if the initial and steady state resistances of the limiter are appropriate and, most importantly, only if the mass of the thermistor material is sized appropriately.

As described herein, the term "limiter" means a thermistor and possibly also a paralleling resistor. The paralleling resistor is especially appropriate in higher wattage lamps (which normally require a higher mass thermistor) as the use of a paralleling resistor reduces the ratio of thermistor to filament initial current and thus reduces the required thermistor mass.

It should also be noted that the effective thermistor mass is the key quantity in that while this is generally simply the mass of the thermistor material, it can, in special cases, be either more or less than the thermistor mass.

The effective thermistor mass can be greater than the actual thermistor mass in cases where the thermistor is in especially close thermal coupling with an object having a large thermal mass. As the thermistor must not be shorted out, the thermal mass could be of a highly conductive insulator, such as beryllia, or could be of a conductive material insulated from the thermistor, or of conductive material attached to one or both thermistor contacts. Such configurations are generally unnecessary, and the effective thermistor mass will thus generally not be significantly greater than the actual thermistor mass. Care must be taken to avoid the situation where the effective thermal mass is less than the actual thermistor mass. As the thermistor material has a negative temperature coefficient, localized heating can, under some conditions, produce a tunnelling or thermal filament effect in which the current is localized through a relatively small volume. If the current is concentrated significantly more heavily in one portion of the thermistor, this can cause local heating which drops the resistivity of that portion and this leads to an even greater concentration of current. Thus, the effective mass is approximately the mass of the localized section which is predominantly carrying the current, rather than the entire mass of the thermistor material. This problem is especially important in high resistivity material where the electrical path is short with a high cross-sectional area (i.e., a "pancake" shaped thermistor). Characteristics of thermistor material which lead to thermal filaments include very low thermal conductivity and inhomogeneity (especially voids). As noted previously, thermal filaments are to be avoided, and thus generally the effective mass of the thermistor will be essentially equal to its actual mass.

Given the appropriate initial resistance and an appropriate mass, a thermistor, to be efficient, must have a steady state operating resistance which is less than approximately 1% of the hot resistance of the filament. To obtain an appropriately low steady state resistance, the thermistor must reach a temperature appropriate for the particular thermistor material to provide enough change to its resistance. When used in the base of a lamp, practical types of insulation do not significantly raise the operating temperature of thermistors, and thus any materials which will not reach sufficient temperature when placed within the base of the lamps are best located within the lamp itself. It is also convenient to have the limiter attached to the lamp (either inside the envelope or inside the base) as the filament masses of different types of lamps vary and the limiter should not be used for other than the lamp filament mass for which it was designed. In addition, the filament design of the lamp should probably be modified slightly when the lamp is to be used with a limiter, such that the filament temperature should be maintained (or slightly increased) even though there is a small voltage drop across the limiter.

Of the large number of thermistor materials evaluated, only polycrystalline vanadium dioxide has performed completely satisfactorily while located in the base of the lamp. An appropriately sized vanadium dioxide limiter completely eliminates current overshoot on 40–100 watt bulbs and dissipates about ½ of 1% of the total power.

A number of thermistor materials will function satisfactorily inside the lamp envelope, but there are several factors which make the design of such a configuration more difficult. These factors include difficulties in locating what is often a relatively large volume of limiter material within the envelope, the effect of the bulb atmosphere on the thermistor, and the contamination of the bulb atmosphere by the thermistor. An example of the complications caused by the volume of the thermistor material is illustrated by a 100 watt bulb when the thermistor material is self-heated and not paralleled by a resistor. This arrangement requires about ½ of a cubic centimeter of thermistor material. While it is not impossible to locate such a volume within the envelope of a 100 watt bulb, it can be seen that such a volume does present some difficulties.

With regard to the effect of the atmosphere (within the envelope) on the thermistor, it will be noted that the effects are generally not serious; however, the deposition of tungsten upon the surface of the thermistor does tend to change its characteristics and the halogens of a tungsten-halogen lamp could also affect the thermistor. With regard to the contamination of the atmosphere of the bulb by the thermistor, the major problem appears to be the off gassing of the thermistor adding contaminants such as water vapor to the atmosphere of the envelope.

As noted previously, only a very limited number of thermistor materials will work satisfactorily and only polycrystalline $VO_2$ has been found to operate satisfactorily in the base of the bulb. While silver sulfide has a resistivity which would appear appropriate for operation in the base of the lamp, silver suflide's stability is so poor that it is unusable for these purposes, and typically its electrical characteristics change dramatically the first time it is used as a lamp current inrush limiter. $Ti_2O_3$ is another apparent candidate which will not function satisfactorily. In practical configurations, the resistivity of $Ti_2O_3$ only changes resistivity by about a factor of 20, rather than the factor of at least about 100 which is required.

Of the materials which will function within the lamp envelope, lanthanum cobalt oxide ($LaCoO_3$) and vanadium dioxide are preferred. Both materials have appropriate resistivities. Excessively high resistivities require configurations which have very short lengths and very high cross-sectional areas. Very low resistivities require configurations which have low cross-sectional areas, but in excessively long lengths. Either very high or very low resistivities require configurations which are awkward to mount and tend to have excessively high surface areas which complicates the problem of getting the thermistor material to a significantly high temperature.

FIG. 1 is a graph showing the variation of current with time($I_{T1}$) of a lanthanum cobalt oxide thermistor in series with a 100 watt, 120 volt incandescent filament. It will be noted that complete current limiting is obtained as the inrush current never exceeds the steady state operating current ($I_{SS1}$). The thermistor had a weight of 4.428 grams (a volume of slightly less than ½ of a cubic centimeter) and a ratio of limiter mass to filament mass of approximately 121. A thermal design which obtains a thermistor temperature of about 200°C is required to insure that the steady state power dissipated in the thermistor is less than 1%. No parallel resistor was used in this case; however, the mounting of the thermistor is somewhat awkward because of the relatively high volume. The mass and the volume could have been reduced by the factor of about 3 by the use of a resistor paralleling the thermistor. The hot resistance of a 100 watt bulb is typically approximately 140 ohms. The thermistor resistance in this case is 220 ohms at room temperature (about 125°C) and approximately 1 ohm at the 200°C temperature at the steady state operation.

Figure 2:
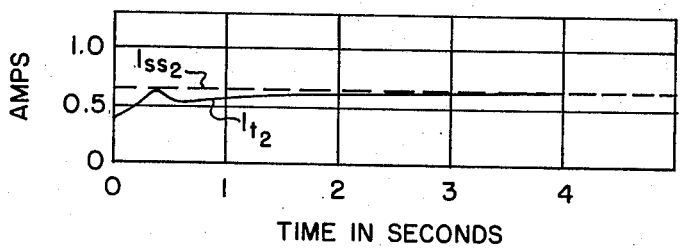
FIG. 2 is a graph showing the variation of current with time of a lamp filament where the current inrush limiter consists of a resistor and thermistor in parallel.

FIG. 2 shows the graph of current vs. time ($I_{T2}$) for a germanium thermistor where a paralleling resistor is used to reduce the required thermistor mass. Again, the current never exceeds the steady state operating current ($I_{SS2}$). The filament was a 75 watt, 120 volt tungsten filament. The thermistor had a room temperature resistance of approximately 670 ohms and a hot resistance at 270°C of approximately 1 ohm. The paralleling resistor had a resistance of 450 ohms. The thermistor weight was approximately 0.834 gram which provides a thermistor to filament mass ratio of about 33.75. The resistor can be conveniently located in the base of the lamp; however, this configuration requires a third lead-in conductor.

Both lanthanum cobalt oxide and praseodymium cobalt oxide could also be used, either with or without a paralleling resistor and in approximately the same masses, the primary difference being that lanthanum cobalt oxide has a lower resistivity and requires longer thermistors with a lower cross-sectional area.

Figure 3:
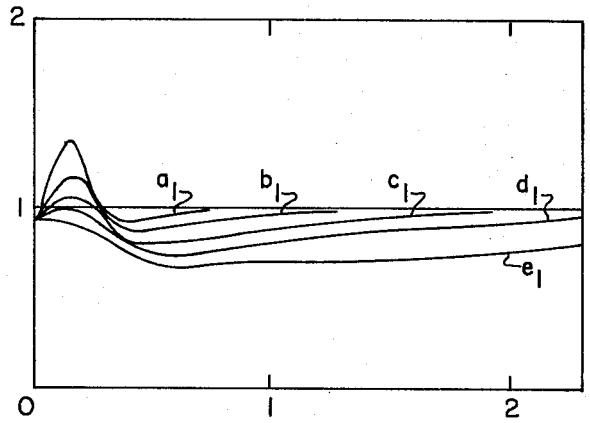
FIG. 3 is a graph showing the variation of current with time for five different ratios of mass of thermistor to mass of filament, where the cold limiter resistance is approximately equal to the hot filament resistance.

FIG. 3 shows the variation of lamp current with time for five different thermistor to filament mass ratios where the cold limiter resistance is equal to the hot filament resistance. In FIG 3 (as is in FIGS. 4, 5 and 6) no resistor paralleling the thermistor is used. In FIG. 3 (as in FIGS. 4, 5 and 6) the thermistor to filament mass ratios for the curves are as follows: the *a* curve has a 15.9 to 1 mass ratio; the *b* curve has a 22.7 to 1 mass ratio; the *c* curve has a 31.8 to 1 mass ratio; the *d* curve has a 45.5 to 1 mass ratio; and the *e* curve has a 90.9 to 1 mass ratio. The subscripts indicate the cold limiter/-hot filament resistance ratio (1 in FIG.3, 1.5 in FIG. 4, etc.) It can be seen that the $a_1$ curve, the $b_1$ curve and the $c_1$ curve all illustrate cases where the inrush current is not eliminated, but that the $d_1$ and the $e_1$ curves both illustrate cases where the resistance and the mass of the limiter are in a combination which eliminates current overshoot. The curves of FIG. 3 (and also in FIGS. 4, 5 and 6) are for polycrystalline vanadium oxide having a composition of approximately $VO_2$. For other thermistor materials, the curves should be corrected for the difference in calories/gram between the hot heat content per unit mass (at steady state operating temperature) of the thermistor and the cold heat content per unit mass (at about room temperature) of the thermistor. It will be noted that materials which exhibit a very abrupt or switching characteristic with time will not eliminate the current overshoot and are to be avoided. The curves are typical of materials which will work and the curves in FIG. 1 and FIG. 2 for lanthanum cobalt oxide and praseodymium cobalt oxide are generally similar in shape to the curves of the vanadium dioxide, and in particular, to the curves of FIG. 4 (the FIGS. 1 and 2 resistance ratios are approximately that of FIG. 4).

Figure 4:
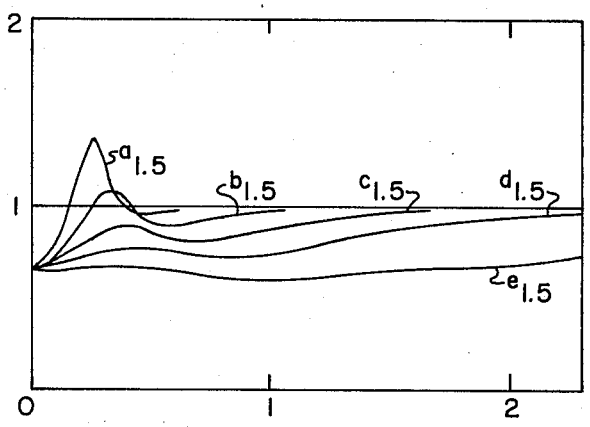
FIG. 4 shows the same relationships as FIG. 3, but where the cold limiter resistance is about 1½ times the hot filament resistance.

FIG. 4 shows curves similar to those of FIG. 3, but with an initial limiter resistance to steady state filament resistance ratio of 1.5. The two lower mass curves ($a_{1.5}$ and $b_{1.5}$) do not eliminate the current overshoot, while the three heavier mass curves ($c_{1.5}$, $d_{1.5}$, and $e_{1.5}$) show the elimination of the current overshoot. By comparison with FIG. 3, it can be seen that a somewhat lighter mass is usable with the somewhat higher initial limiter resistance, and that in particular, the 31.8 mass ratio of the *c* curve eliminates current overshoot with the 1.5 to 1 resistance ratio of FIG. 4, but not with the 1 to resistance 1 ratio of FIG. 3.

Figure 5:
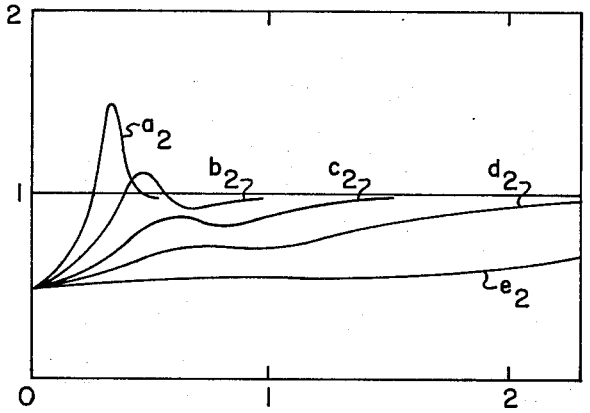
FIG. 5 shows the same relationships as FIGS. 3 and 4, but where the cold limiter resistance is twice the hot filament resistance.

FIG. 5 shows curves similar to those of FIGS. 3 and 4, but where the cold limiter resistance is twice the hot filament resistance. Again, the lighter two mass ratios ($a_2$ and $b_2$) do not eliminate current overshoot, but the three heavier mass ratios ($c_2$, $d_2$ and $e_2$) completely eliminate the current overshoot.

Figure 6:
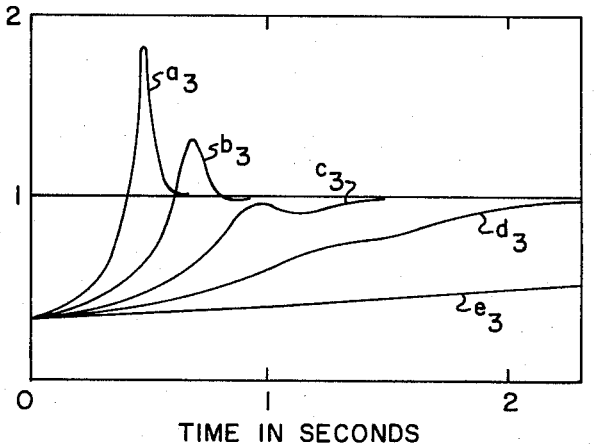
FIG. 6 shows the same relationships as FIGS. 3, 4 and 5, but where the cold limiter resistance is three times the hot filament resistance.

FIG. 6 shows the same general relationships as FIGS. 3, 4 and 5, but where the cold limiter resistance is three times the hot filament resistance. It can be seen that the lower two masses again have not eliminated the current overshoot but that the larger three masses have again completely eliminated the current overshoot. It can also be seen that the larger filament resistances (for a given filament size) have delayed the current overshoot in curve $b_3$, for example, as compared to FIGS. 3, 4 and 5, but have not eliminated the current overshoot. A comparison of those $b_2$ and $b_3$ curves together with a comparison of curves $c_2$ and $c_3$, indicates that a somewhat higher minimum mass is required using the higher thermistor resistance ratios of FIG. 6.

Figure 7:
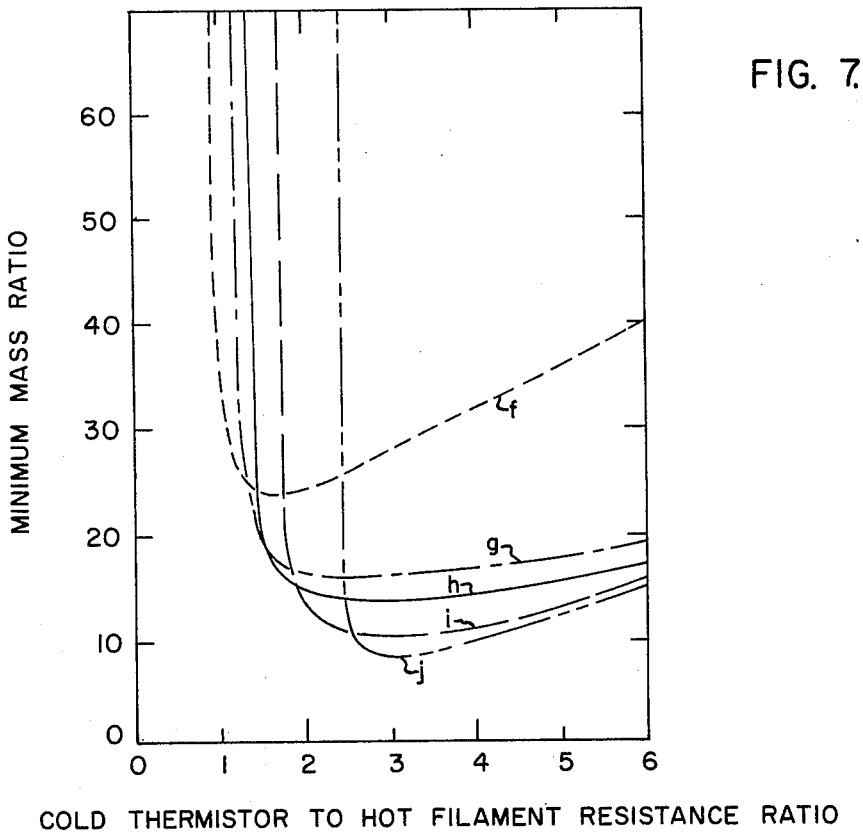
FIG. 7 is a graph showing the masses which are required to eliminate current overshoot with various ratios of thermistor resistance to filament resistance without a parallel resistor and also with several different paralleling resistors.

The minimum required mass for various resistance ratios is plotted in FIG. 7. Curve *f* is a plot of the minimum mass ratio against cold thermistor to hot filament resistance ratio without a parallel resistor. Curves *g*, *h*, *i* and *j* are curves using resistors in parallel with the thermistors where the ratio of resistance of the parallel resistor to the hot filament resistance is as follows: *g* is for a ratio of 4; *h* for a ratio of 3; *i* for a ratio of 2; and *j* for a ratio of 1½. FIG. 7 is for polycrystalline vanadium dioxide and the previously noted correction (the difference between hot and cold heat content per unit mass of the thermistor) should be made for other thermistor materials. The use of near minimum masses provides a rapid turn-on in which the delay is generally imperceptible to the human eye.

Excessively high thermistor masses should also be avoided. Not only do excessively high thermistor masses add to the cost and the difficulty of lamp construction and tend to have significantly higher heat losses, but also the use of excessively large thermistor masses can lead to excessive delay in the turn-on time. While a turn-on time in a matter of a second is not generally undesirable, excessively long delays before appreciable light is emitted (10 seconds or more) are generally inconvenient and probably serve no useful purpose. It should be noted that a higher mass, together with a cold thermistor resistance of close to the hot filament resistance, can cause a lamp to glow shortly after turn-on and then increase in intensity over a period of time. With regard to an intensity smoothly increasing over a period of a few seconds, many people have found such a gradual turn-on pleasing, as the added time gives a person's eyes the time to adjust.

The typical commercial incandescent lamps of less than 40 watts are vacuum bulbs, while those of 40 watts or more are typically gas-filled. In a thermistor mounted inside the envelope, it is somewhat easier to obtain higher operating temperatures (and therefore lower operating resistances) within the vacuum bulb. Tests have also shown that vanadium dioxide limiters operating outside the bulb have a slightly lower minimum mass for vacuum bulbs than for gas-filled bulbs (for reasons not fully understood).

A typical 25 watt, 120 volt commerical lamp has a hot resistance of about 576 ohms and a filament mass of about 8.2 milligrams. A typical 40 watt bulb has a hot resistance of about 360 ohms and a filament mass of 8.07 milligrams. A typical 60 watt bulb has a hot resistance of about 240 ohms and a filament mass of about 17.4 milligrams. A typical 100 watt bulb has a hot resistance of about 144 ohms and a filament mass of 36.6 milligrams. It can be seen from the preceding data that the filament masses generally go up with the bulb wattage and that the mass and the volume of the thermistor material are generally more of a problem with the higher wattages. As the use of a parallel resistor reduces the required mass and volume, the parallel resistor finds its greatest application in the higher wattage bulbs.

To provide a practical current inrush limiter, the limiter resistance (the equivalent resistance of the thermistor with any paralleling resistor) should be between 0.9 and 10 times the hot resistance of the filament. With tungsten filament, the minimum resistance is generally about 0.93 times the hot resistance of the filament. Resistances of greater than 10 times the hot resistance of the filament serve no useful function and, as can be seen from FIG. 7, after a certain point, higher resistances actually increase the required minimum mass ratio. The minimum mass ratios occur with a cold-thermistor-to-hot-filament resistant ratio generally between about 1.5 and 3, and this is the preferred range.

Generally, the steady state operating resistance of the limiter should be less than about 1% of the hot resistance of the filament. On a standard 40 watt bulb, for example, this allows (with a slight redesign for a slightly higher filament operating temperature not only a greater than normal light output but also an increased life. The lower the steady state operating resistance of the limiter, the more efficient the combination can be, and preferably, the resistance should be less than ½ of 1% of the hot resistance of the filament (as provided by a $VO_2$ limiter either in the lamp base or in the lamp envelope, for example).

In addition to having the proper resistances, the thermistor should also have an appropriate effective mass. This mass is proportional to the mass of the filament, also proportional to the initial ratio of thermistor current to filament current. This ratio is, of course, a function of the cold resistance of the thermistor as compared to any parallelling resistor and is equal to one if there is no paralleling resistor. The thermistor mass is indirectly proportional to the difference between the hot heat content per unit mass of the thermistor and the cold heat content per unit mass of the thermistor. When the heat contents are in calories/gram, the constant of proportionality is between 400 and 4,000. Preferably, the constant is between 1000 and 4,000 in circuit arrangements to provide a gradual turn-on and between 400 and 1600 in circuit arrangements to provide a rapid turn-on (with rapid turn-on there is no perceptible delay).

A number of thermistor materials in addition to those previously mentioned can also be made to work, with the principal difficulty being obtaining a high enough steady state operating temperature, and thus a low enough operating resistance to allow efficient operation. Indium arsenide, neodymium cobalt oxide, samarium cobalt oxide, europium cobalt oxide, germanium and silicon are some examples. Some of these materials, such as germanium, have the disadvantage of being relatively expensive.

Figure 8:
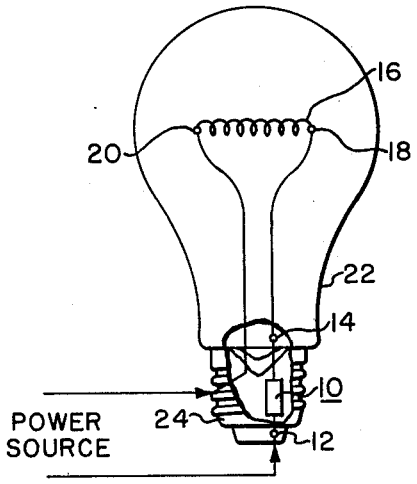
FIG. 8 shows an incandescent lamp having a current inrush limiter in electrical series relationship with an incandescible tungsten lamp filament and in which the current inrush limiter is contained within the base of the lamp.

FIG. 8 shows an incandescent lamp with a screw-type base and the thermistor located in the base. Such a location is convenient in that it avoids the aforementioned problems of locating the thermistor within the lamp envelope and assures that the thermistor can be properly sized for the particular size filament. To date, vanadium dioxide is the only material which has been made to work satisfactorily within the base of the lamp. Vanadium dioxide is not expensive, and a sufficient mass of vanadium oxide can be placed inside the base for most size lamps and therefore a paralleling resistor is generally unnecessary. In particular, the thermistor 10 has a first terminal 12 and a second terminal 14 and is electrically connected in series with an incandescible lamp filament 16. The incandescible lamp filament 16 has a first terminal 18 and a second terminal 20. The second thermistor terminal 14 is electrically connected to the first filament terminal 18 and the first thermistor terminal 12 and the second filament terminal 20 are adapted to be individually electrically connected to a power source. The filament 16 is located within the light transmitting envelope 22. The thermistor 10 is located outside the light transmitting envelope 22 but inside the screw-type base 24. The thermistor 10 has hot and cold resistances and a mass sized as taught herein. While a number of the thermistor materials taught herein could be used in this configuration if sufficient thermal insulation were provided (i.e., the thermistor placed in a miniature vacuum bottle), vanadium oxide is the most practical material and the only known material which will work in this configuration without such special thermal insulation. Such a configuration is especially convenient in the lower wattage lamps (up to about 100 watts).

Figure 9:
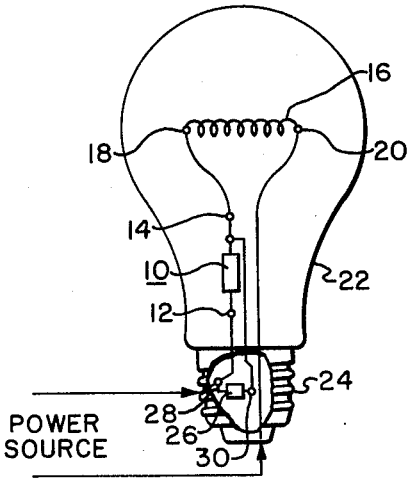
FIG. 9 shows an incandescent lamp with a limiter contained within the lamp envelope and with a paralleling resistor contained within the base of the lamp.

FIG. 9 illustrates a configuration in which the thermistor material is located within the lamp envelope and a paralleling resistor is used. The thermistor 10 is located within the light transmitting envelope 22. A resistor 26 having a first terminal 28 and a second terminal 30 is located within the screw-type base 24. The second terminal 14 of the thermistor 10 is electrically connected to the first terminal 18 of the filament 16 and also electrically connected to the second terminal 30 of the paralleling resistor 26. The first terminal of the resistor 26 is electrically connected to the first terminal 12 of the thermistor 10 and these terminals 12, 28 are adapted to be connected to one side of the power source. The second terminal 20 of the filament 16 is adapted to be connected to the other side of the power source. This configuration is especially convenient on higher wattage lamps (about 100 watt and above). The thermistor 10 can be of a number of different materials, including lanthanum cobalt oxide, praseodymium cobalt oxide and indium arsenide. Preferably, the thermistor 10 is lanthanum cobalt oxide or $VO_2$.

There are, of course, a number of alternative configurations. The configuration of FIG. 9 could be modified, for example, by locating the paralleling resistor 26 within the lamp envelope 22, or by omitting the paralleling resistor 26.

With the exception of silicon, germanium, and indium arsenide, the thermistor materials described herein are polycrystalline materials. The preparation of the thermistor materials is generally well known with the exception of the various cobalt oxides. The cobalt oxides can be prepared generally by the precipitation method described (for lanthanum cobalt oxide) by T. K. Gallagher in the Materials Research Bulletin No. 3, pages 225–232, 1968.

We claim:

1. A circuit arrangement for effectively eliminating the inrush-current overshoot when an incandescent lamp is connected to a power source, said circuit arrangement comprising:

a. an incandescible tungsten lamp filament; and b. a current-inrush limiter comprising a negative temperature coefficient thermistor electrically connected in series with said filament, said current-inrush limiter having a room temperature resistance of between about 0.9 and 10 times the hot resistance of said filament and a steady state operating resistance of less than about 1% of said hot resistance of said filament, and said thermistor having an effective mass equal to a constant multiplied by the mass of the filament multiplied by the initial ratio of thermistor current to filament current, and divided by the difference in calories/gram between the hot heat content per unit mass of the thermistor and the cold heat content per unit mass of the thermistor, where said constant is between 400 and 4000.

2. The circuit arrangement of claim 1, wherein said constant is between 400 and 1600.

3. The circuit arrangement of claim 1, wherein said lamp is to have a gradual turn-on and said constant is between 1000 and 4000.

4. The circuit arrangement of claim 1, wherein said steady state operating resistance of said limiter is less than about ½% of said hot resistance of said filament.

5. The circuit arrangement of claim 1, wherein said thermistor substantially comprises a material selected from the group consisting of $VO_2$ and $LaCoO_3$.

6. The circuit arrangement of claim 5, wherein said lamp has a screw-type base and said thermistor substantially comprises $VO_2$ and said thermistor is located in said base.

* * * * *